United States Patent [19]

Wallis

[11] Patent Number: 4,592,254

[45] Date of Patent: Jun. 3, 1986

[54] RATCHET WRENCH

[76] Inventor: Frederick A. Wallis, 9 Mosaic Street, Shelley, Western Australia, Australia

[21] Appl. No.: 579,882

[22] PCT Filed: May 24, 1983

[86] PCT No.: PCT/AU83/00067

§ 371 Date: Jan. 18, 1984

§ 102(e) Date: Jan. 18, 1984

[87] PCT Pub. No.: WO83/04208

PCT Pub. Date: Dec. 8, 1983

[30] Foreign Application Priority Data

May 24, 1982 [AU] Australia ..... PF4122

[51] Int. Cl.[4] ..... B25B 13/46

[52] U.S. Cl. ..... 81/57.39; 81/58.1; 81/57.46

[58] Field of Search ..... 81/57.39, 57.46, 60, 81/61, 57.13, 58.1

[56] References Cited

U.S. PATENT DOCUMENTS

| | | | |
|---|---|---|---|
| 1,903,514 | 4/1933 | Merriman et al. | 81/57.46 |
| 2,690,689 | 10/1954 | Batcha | 81/57.46 |
| 2,817,257 | 12/1957 | Kniser | 81/57.39 X |
| 3,124,983 | 3/1964 | Emerzian . | |
| 3,272,037 | 9/1966 | Bruehl | 81/57.46 X |
| 3,572,188 | 3/1971 | Christian, Jr. | 81/57.46 |
| 3,859,875 | 1/1975 | Bieganski . | |
| 4,098,151 | 7/1978 | Bliss . | |
| 4,099,430 | 7/1978 | Stodola . | |
| 4,141,262 | 2/1979 | Smith . | |
| 4,231,271 | 11/1980 | Yamada . | |

FOREIGN PATENT DOCUMENTS

| | | |
|---|---|---|
| 962575 | 6/1950 | France . |
| 1505542 | 12/1967 | France . |

*Primary Examiner*—Frederick R. Schmidt
*Assistant Examiner*—Debra S. Meislin
*Attorney, Agent, or Firm*—Fleit, Jacobson, Cohn & Price

[57] ABSTRACT

A tool for turning a rotatable element for example, nuts, bolts or screws, the tool including a body having a drive head at one end of a handle which consists of a fixed portion and a movable portion connected by a flexible cable to an element driving socket via side plate pawl and ratchet teeth so that movement of the movable handle portion towards the fixed handle portion causes rotation of the socket while during movement of the movable handle portion away from the fixed handle portion by the action of a return spring, the socket is prevented from rotation by another pawl and the ratchet teeth.

4 Claims, 3 Drawing Figures

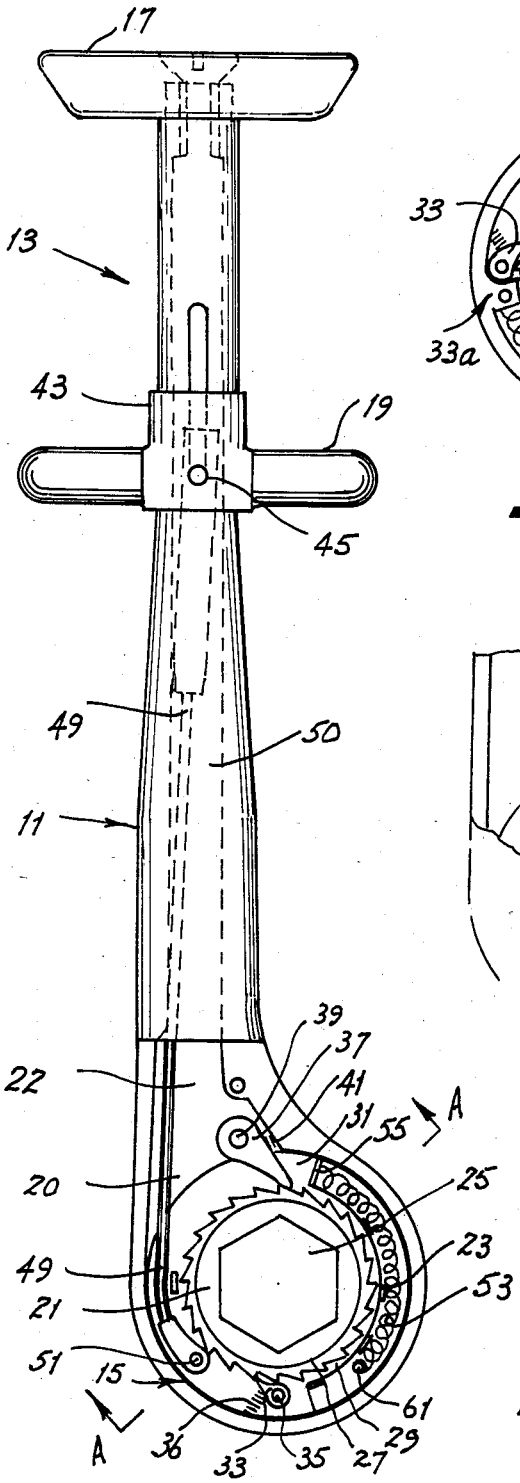
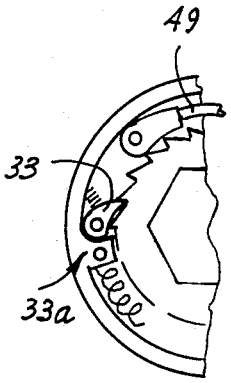
Fig. 3
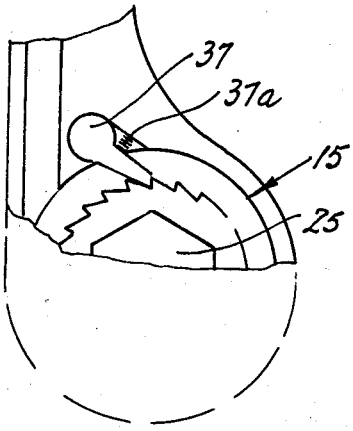
Fig. 2
Fig. 1

RATCHET WRENCH

This invention relates to a tool for turning a rotatable element.

Throughout this specification, the term "rotatable element" is taken to include nuts, bolts, screws and like fastening elements which are adapted to be fastened or loosened by a turning action.

Screw-type fixing elements such as machine screws, bolts and nuts are generally loosened and fastened by means of a spanner which has a jaw or socket for engaging the fixing element and a handle by means of which the spanner may be turned to effect the turning action of the fixing element. These fixing elements are sometimes located in confined areas in which it is inconvenient, or perhaps not possible, to use a conventional spanner.

It is an object of this invention to provide a tool for turning a rotatable element which tool is not required to be rotated about the axis of rotation of the fixing element.

A number of attempts have been made to produce tools which meet the above criteria. One such tool is described in U.S. Pat. No. 2,690,684 to Batcha. This patent requires a two handed operation with a spiral spring rewinding cord which winds onto a drum. This necessitates the body of the tool having considerable axial width which mitigates its use in a confined space. Further, to obtain increased torque, the drive has to be locked by a plunger arrangement so that no ratchet operation is available.

Broadly the invention resides in a tool for turning a rotatable element comprising a body having a device head and a handle, the drive head includng an engaging member rotatable in one direction and adapted to drivingly engage the rotatable element, a driving member movable between first and second positions, the driving member being operatively coupled to the engaging member whereby movement of the driving member in one direction imparts rotational torque to the engaging member and movement of the driving member in the other direction does not impart rotational torque to the engaging member, said handle including reciprocating means coupled to the driving member.

The present invention also resides in a tool for turning a rotatable element comprising a body having a drive head and a handle, an annular engaging member rotatably mounted in the drive head with its inner face defining a multi-walled socket to receive the rotatable element, an adapter or a drive shaft and with a plurality of ratchet teeth around its outer perimeter, side plates rotatably mounted in the drive head co-axial with the engaging member, means for partially rotating the side plates coupled to an operating member mounted on or incorporated in the handle, spring means to resist the rotation of the side plates, a first pawl mounted on the side plates to engage the ratchet teeth and effect rotation of the engaging member when the side plates are rotated with the operating member and a second pawl mounted on the body to engage the ratchet teeth and prevent rotation of the engaging member as the side plates return to their original position under the action of the spring means.

In another form the invention resides in a tool for turning a rotatable element comprising: a body having a drive head and a handle, the drive head including an engaging member rotatable in one direction and adapted to drivingly engage the rotatable element, a driving member movable between first and second positions, the driving member being operatively coupled to the engaging member whereby movement of the driving member in one direction imparts rotational torque to the engaging member and movement of the driving member in the other direction does not impart rotational torque to the engaging member, said handle including a fixed handle portion and a movable handle portion, the movable handle portion being movable between first and second positions with respect to the fixed handle portion, the movable handle portion being operatively coupled to the driving member whereby movement of the movable handle from the first position to the second position thereof effects rotational movement of the driving member in said one direction from the first position to the second position thereof, and return means for returning the driving member and the movable handle to their respective first positions.

In another form, the invention resides in a tool for turning a rotatable element comprising a body having a drive head and a handle, an annular engaging member rotatably mounted on the drive head with its inner face defining a multi-walled socket to receive the rotatable element, an adapter or a drive shaft and with a plurality of ratchet teeth around its outer perimeter, two side plates rotatably mounted in the drive head co-axial with the engaging member, means for partially rotating the side plates coupled to an operating member mounted on or incorporated in the handle, spring means to resist the rotation of the side plates, a first pawl mounted on the side plates to engage the ratchet teeth and effect rotation of the engaging member when the side plates are rotated with the operating member and a second pawl mounted on the body to engage the ratchet teeth and prevent rotation of the engaging member as the side plates return to their original position under the action of the spring means, said handle including a fixed handle portion and a movable handle portion forming the operation means, the movable handle portion being movable between first and second positions with respect to the fixed handle portion, the movable handle portion being operatively coupled to the driving member whereby movement of the movable handle from the first position to the second position thereof effects rotational movement of the driving member in said one direction from the first position to the second position thereof, and returns means for returning the driving member and the movable handle to their respective first positions.

According to a preferred feature of the invention, the movable handle portion is slidably mounted on the body for movement towards and away from the fixed handle portion, the movable handle portion and the fixed handle portion being disposed in single hand grip relationship.

The invention will be better understood by reference to the following description of one specific embodiment thereof as shown in the accompanying drawings:

FIG. 1 is a schematic elevational view of the tool, with the cover plate for the drive head removed to reveal the components of the drive head;

FIG. 2 is a fragmentary view showing an alternative mounting of the main pawl;

FIG. 2A is a section on line A—A of FIG. 1;

FIG. 3 is a fragmentary view showing an alternative form wherein the second pawl shares the thrust.

Referring to the drawings, the tool comprises a body 11 having a handle 13 and a drive head 15 at one end of the handle. The handle 13 includes a fixed handle portion 17 at the other end of the body and a movable handle portion 19 slidably mounted on the body for movement towards and away from the fixed handle portion 17. The fixed handle portion 17 and the movable handle portion 19 are disposed in single hand grip relationship whereby the fixed handle portion 17 may be received in the palm of one hand of a user and the movable handle portion 19 engaged by two fingers of that hand.

The drive head is housed in a compartment 20 formed within the body 11, the compartment being defined between a pair of side walls 22 one of which forms part of the body. The other side walls is in the form of a removable cover plate which permits access to the compartment; in the drawing, the side wall which constitutes the cover plate is the near side wall and this is shown removed to reveal the components of the drive head.

The drive head 15 includes a substantially annular housing engaging means 21 in the form of a socket housing 23 defining a multi-walled socket 25. The socket 25 is adapted to receive one end of a drive shaft (not shown) the other end of which is adapted to support a socket for gripping a nut or the head of a bolt. The outer wall 27 of the housing 21 is cylindrical and has upstanding ratchet teeth 29 formed thereon. The socket housing 21 is received in the compartment 20 and is rotatably supported between the side walls 22. A pair of side plates 31 are disposed one on each side of the ratchet teeth 29 (only one of the side plates 31 appears in the drawings, the other side plate having been removed to reveal the other components in the drive head). Each side plate 31 is formed with an opening (not visible) to receive the adjacent end portion of the housing 21. A first pawl 33 is pivotally mounted on a pin 35 which extends between the side plates 31. The pawl 33 is adapted to co-operate with the ratchet teeth 29 to permit the socket housing 23 to rotate relative to the side plates 31 in one direction and restrain the socket housing from rotation relative to the side walls 22 in the other direction. A compression spring 36 biases the pawl 33 into engagement with one of the teeth 29. As shown in FIG. 3 of the drawings an anchor block 33A may be provided to support the pawl 33 and enable it to take some of the thrust when the tool is used as a conventional ratchet wrench. A second or main pawl 37 is rotatably mounted on a pin 39 fixed to the body. The second pawl is biased into its engagement with the ratchet teeth 29 by means of a compression spring 41 and is adapted to permit rotation of the socket housing relative to the body 11 in said one direction and lock the socket housing against rotation relative to the body in said other direction. It is preferred that the pawl 37 instead of being mounted on a pin as in FIG. 1 may be accommodated in an appropriately shaped recess 37*a* as shown in FIG. 2 of the drawings.

The movable handle portion 19 includes a sleeve 43 which is slidably mounted on the body 11 and which carries a pin 45 which is accommodated in an elongated slot formed in the body. A flexible cable 49 is received in a passage 50 in the body 11 and is secured at one of its ends to the pin 45 and at the other of its ends to a pin 51 extending between the side plates 31. With this arrangement, movement of the movable handle 19 towards the fixed handle portion 17 causes the side plates 31 to undergo limited rotation relative to the body 11. A return spring 53 is located between a projection 55 on one of the side plates 31 and a stud 61 secured to the body; the return spring 53 undergoes compression on movement of the movable handle portion 19 in the direction towards the fixed handle portion 17.

The return spring 53 causes the side plates 31 to return to their initial position when the force applied to the movable handle portion 19 is removed; this also has the effect of moving the movable handle portion 19 away from the fixed handle portion 17. Co-operation between the first pawl 33 and the ratchet teeth 29 effects rotation of the housing 21 on rotation of the side plates 31 in said one direction resulting from movement of said movable handle portion 19 towards a fixed handle portion 17. Return movement of the side plates 31 under the action of the return spring 53 is not transmitted to the housing 21 because of the arrangement of the pawl 33 and the ratchet teeth 29; indeed, co-operation between the second pawl 37 and the ratchet teeth 29 locks the housing 21 against such movement. The overall effect of this is that rotational torque is applied to the housing 21 on movement of the movable handle portion 19 towards the fixed handle portion 17, and that rotational torque is not transmitted to the socket housing on movement of the movable handle portion away from the fixed handle portion 17.

To use the tool, a socket of the size to grip the nut or bolt head to be turned is selected and fitted onto one end of a drive shaft the other end of which is fitted into the socket 25. To turn the nut or bolt head, the user grips the tool with one hand, the fixed handle portion 17 being received in the palm of the user's hand and the movable handle portion 19 being gripped by two fingers. By manipulation of these two fingers, the user is able to move the movable handle portion 19 towards the fixed handle portion 17 and thereby cause the side plates 31 to rotate.

This in turn causes the housing 21 to rotate and thereby turns the nut or bolt head. The user then releases the movable handle portion 19 and it is returned to the initial position by the action of the return spring 53. The procedure is continued until the operation is complete.

The tool may be used for both tightening or loosening operations; in order to change from one operation to the other, it is merely necessary to reverse the tool (i.e. locate the nut or bolt engaging socket on the other side of the drive head).

It should be appreciated that the scope of the invention is not limited to the scope of the embodiment described. The tool may be utilised to perform operations other than the tightening or loosening of nuts and bolts; it may, for example, be used in conjunction with a screw driving tip to permit the insertion or withdrawal of screws. Also it may be fitted with a flexible drive i.e. the cable 49 is housed in a flexible sheath connected between the handle and the drive head.

It should be understood that the second pawl 37 allows the tool to be used as a conventional ratchet wrench without any adjustment of any kind.

The 'remote drive' facility of the tool of the present invention is the solution to those frustrations—so frequent in vehicle and machine work—where limited accessibility makes the usual spanners very difficult to use and where fasteners are invariably too tight for the fingers (even when reachable). It is in these situations also that a screw or nut can be incredibly difficult to start—or prevented from falling into sumps and the like when unscrewed.

With the invention the rotational movement required in these awkward places is only the small amount required for final tightening or initial loosening.

The inserted sockets hold a nut, or bolt-head, captive and thus complement the remote drive for 'starting' and 'taking-up' or removal and retention; of fasters in confined locations.

Further, the inserted sockets do not slide off a fastener axially (a common nuisance with all but the usual sockets;) however they do not have the depth restriction of the usual 'blind' sockets so that the tool can follow a nut along a long thread.

The tool of the present invention together with its inserted sockets is thinner than most other ratchets (approximately 11mm for a model taking up to 20mm sockets) and can be operated where most other 'closed' spanners cannot be engaged.

Any common sockets and attachments plus drivers for slotted, Allen, Philips head screws and the like may be used.

The tangential orientation of the handle not only results in lower material stress than the usual radial handles—hence allowing it to be slim, even though hollow—but provide a conveniently seen; or felt (in confined places;) indication of tightening or loosening attitude.

THE CLAIMS defining the invention are as follows:

1. A tool for turning a rotatable element, said tool comprising:

a body having a drive head and a handle;

said handle including a fixed handle portion and a movable handle portion being movable between a first position and a second position positioned with respect to the fixed handle portion;

said movable handle portion being slidably mounted on said handle in a single hand grip relationship so that movement along a length of said handle is effected to said movable handle portion by a single hand while said fixed handle portion is simultaneously being gripped by said single hand;

an annular engaging member rotatably mounted in the drive head with its inner face defining a multi-walled socket for receiving the rotatable element, said engaging member including a plurality of ratchet teeth around its outer perimeter;

a pair of axially spaced side plates rotatably mounted in the drive head co-axial with the engaging member;

an elongated member coupled to said movable handle portion and coupled to said side plates at an outer radial surface of said side plates for partially rotating said side plates by movement of said movable handle portion;

spring means for resisting the rotation of said side plates;

said movable handle portion being operatively coupled to said elongated member so that movement of the movable handle portion from the first position to the second position effects rotational movement of the side plates and said spring means moving the side plates and returning the movable handle portion to said first position;

a first pawl mounted on said side plates to engage the ratchet teeth and effect rotation of the engaging member when said side plates are rotated by the movable handle portion; and a second pawl mounted on the body to engage the ratchet teeth and prevent rotation of the annular engaging member as said side plates are returned to an original position under the action of said spring means.

2. A tool as claimed in claim 1 wherein said elongated member includes a flexible drive.

3. A tool for turning a rotatable element, said tool comprising:

a body having a drive head and a handle;

said handle including a fixed handle portion and a movable handle portion being movable between a first position and a second position positioned with respect to the fixed handle portion;

said movable handle portion being slidably mounted on said handle in a single hand grip relationship so that movement along a length of said handle is effected to said movable handle portion by a single hand while said fixed handle portion is simultaneously being gripped by said single hand;

an annular engaging member rotatably mounted in the drive head with its inner face defining a multi-walled socket for receiving the rotatable element, said engaging member including a plurality of ratchet teeth around its outer perimeter;

a pair of axially spaced side plates rotatably mounted in the drive head co-axial with the engaging member;

an elongated member coupled to said movable hand portion and coupled to said side plates at an outer radial surface of said side plates for partially rotating said side plates by movement of said movable handle portion;

spring means for resisting the rotation of said side plates;

said movable handle portion being operatively coupled to said elongated member so that movement of the movable handle portion from the first position to the second position effects rotational movement of the side plates and said spring means moving the side plates and returning the movable handle portion to said first position;

said movable handle portion being slidably mounted on the handle between the fixed handle portion and the drive head for movement towards and away from the fixed handle portion;

a first pawl mounted on said side plates to engage the ratchet teeth and effect rotation of the engaging member when said side plates are rotated by the movable handle portion; and a second pawl mounted on the body to engage the ratchet teeth and prevent rotation of the annular engaging member as said side plates are returned to an original position under the action of said spring means.

4. A tool as claimed in claim 3 wherein said elongated member includes a flexible drive.

* * * * *